United States Patent [19]

Sato et al.

[11] Patent Number: 4,549,606

[45] Date of Patent: Oct. 29, 1985

[54] HEAT TRANSFER PIPE

[75] Inventors: Yoshiyuki Sato; Akio Isozaki, both of Kanagawa, Japan

[73] Assignee: Kabushiki Kaisha Kobe Seiko Sho, Kobe, Japan

[21] Appl. No.: 528,795

[22] Filed: Sep. 2, 1983

[30] Foreign Application Priority Data

Sep. 8, 1982 [JP] Japan ..... 57-137119[U]
Nov. 30, 1982 [JP] Japan ..... 57-210370

[51] Int. Cl.[4] ..... F28F 1/42
[52] U.S. Cl. ..... 165/179; 165/184
[58] Field of Search ..... 165/179, 181, 184; 285/137 R

[56] References Cited

U.S. PATENT DOCUMENTS

| | | | |
|---|---|---|---|
| 3,326,283 | 6/1967 | Ware | 165/181 |
| 4,159,739 | 7/1979 | Brothers et al. | 165/184 X |
| 4,166,498 | 9/1979 | Fujie et al. | 165/181 X |
| 4,330,036 | 5/1982 | Satoh et al. | 165/179 |

FOREIGN PATENT DOCUMENTS

| | | | |
|---|---|---|---|
| 1393551 | 2/1965 | France | 165/181 |
| 157369 | 12/1979 | Japan | 165/179 |
| 711339 | 1/1980 | U.S.S.R. | 165/179 |

*Primary Examiner*—William R. Cline
*Assistant Examiner*—Peggy A. Neils
*Attorney, Agent, or Firm*—Oblon, Fisher, Spivak, McClelland & Maier

[57] ABSTRACT

A heat transfer pipe including a cylindrical heat transfer pipe body and a plurality of circumferential or spiral fins integrally formed on the outer surface of the pipe body, the upper portion of each of the fins having one or more circumferential grooves to divide it circumferencially into at least two parts and a plurality of axially extending breaks to divide it axially into a number of parts. The fins further may have notches formed therein with a predetermined pitch in a direction crossing the fins to divide them into a plurality sections, and a plurality of discrete beads are integrally formed on the inner surface of the body along imaginary lines having a lead angle which is in verse relation to the lead angle of the fins, the beads being formed on at least some of the intersections between the imaginary lines and the fins.

11 Claims, 15 Drawing Figures

HEAT TRANSFER PIPE

BACKGROUND OF THE INVENTION

1. Field of the Invention

The present invention relates to a heat transfer pipe. More particularly, it relates to a head transfer pipe wherein a medium to be cooled is passed along its outer surface and a cooling medium is passed along its inner surface, both surfaces of which, respectively, have a specified configuration thereby maximizing the efficiency of heat exchange between these media by means of these configurations.

2. Description of the Prior Art

A construction for a refrigerant condenser used in refrigerators, coolers and the like has been generally known to have a plurality of heat transfer pipes which are disposed within a cylindrical shell and a medium, e.g. refrigerant gas, flowing on the outer surface of the pipes being condensed by a cooling medium such as water flowing within the pipe. For an improvement of the efficiency of heat exchange of such heat transfer pipes, many approaches, such as the following, have been studied;

(i) An increase in the effective area of heat exchange per unit length of the heat transfer pipe by forming spiral fins on the outer surface of the pipe by means of a rolling tool, thereby manufacturing a so-called "low fin heat transfer pipe" 100 as shown in FIGS. 1 and 2. The condensate of the refrigerant which forms during heat exchange would remain on the surface of the fins 111, the shape of which is rectangular in cross-section, to form liquid film f which substantially decrease the efficiency of heat transfer. On the other hand, it may be possible to increase the number of rows of fins in the axial direction of the pipe so as to substantially enlarge its outer surface. However, the narrow grooves between the fins are filled with the condensate during heat exchange so that an increase in the efficiency of heat transfer cannot be expected. It is also possible to form taller fins, which require large shells to dispose therein these fins, resulting in large and heavy condensers. In the case where the condensers are assembled by a shell-and-tube system, its assembly is troublesome and labor consuming.

(ii) A decrease in the formation of liquid film on the surface of the fins by plowing or cutting the fins to make their tips thin as shown in FIG. 3. The thin tips of the fins allow a certain amount of condensate to flow immediately into the grooves 120 between the fins 111 so that the formation of liquid films f is decreased, thereby improving the efficiency of heat transfer. However, since the formation of liquid film is unavoidable the resulting efficiency of heat transfer is still lower;

(iii) Prevention of the formation of liquid film by treating the heat transfer surface of the pipe by means of a coating. This approach is theoretically advantageous but impractical because such a surface treatment technique is still incomplete at this moment;

(iv) An improvement in the efficiency of heat transfer on the inner side of the pipe. This is not effective when the shell side heat transfer coefficient is more dominant than the tube side heat transfer coefficient because it is not intended to eliminate the condensate of the refrigerant on the outer surface of the pipe.

All the above-mentioned approaches cannot provide heat transfer pipes having a high efficiency of heat transfer while being small in size and light weight in construction.

U.S. Pat. No. 4,330,036 discloses a heat transfer pipe, on the outer surface of the body of which a number of fins are integrally formed. Although, the fins are divided into a plurality of sections by spirally running breaks with a predetermined pitch to enlarge the effective area of heat exchange of the pipe, the resulting efficiency of heat exchange, especially the efficiency of condensation heat exchange with relation to the outer surface area of the pipe, is still insufficient.

SUMMARY OF THE INVENTION

This invention was completed based on the recognition that heat transfer efficiency can be surprisingly increased by dividing the upper portion of each fin into a plurality of parts and decreasing the heat transfer resistance on the inner side of the pipe.

Thus, the heat transfer pipe of this invention which overcomes the above-discussed disadvantages of the prior art, comprises a cylindrical heat transfer pipe body and a plurality of circumferential or spiral fins integrally formed on the outer surface of said body, the upper portion of each of said fins having one or more circumferential grooves to divide the same circumferentially into at least two parts and a plurality of axially extending breaks to divide it axially into a number of parts. The depth of said breaks is preferably greater than that of said circumferential grooves on the upper portion of each fin.

The circumferential or spiral fins further have breaks formed therein with a predetermined pitch in a direction crossing the fins to divide them into a plurality of sections and a plurality of beads are integrally formed in an independently projecting relation on the inner surface of said pipe body along imaginary lines having a lead angle which is in reverse relation to the lead angle of said fins, said beads being formed on at least some of the intersections between said imaginary lines and said fins. The space between said fins is preferably larger than the width of said breaks.

Thus, the invention described herein makes possible the objects of (a) providing a heat transfer pipe wherein the heat transfer efficiency can be significantly increased and (b) providing a heat transfer pipe having a compact and light-weight construction.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENTS

The arrangement, functions and effects of the invention will now be described with reference to the drawings showing embodiments of the invention. The following illustrates the most typical examples, but it is to be understood that these are not intended to limit the scope of the invention and that changes and modifications thereof are within the technical scope of the invention.

Figure 6:
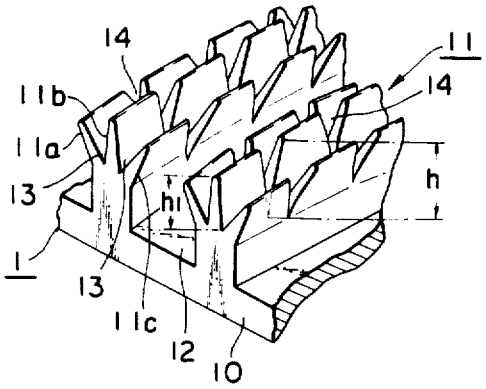
FIG. 6 is a partly enlarged perspective view of a heat transfer pipe according to this invention.

FIG. 6 shows a heat transfer pipe 1 according to this invention, which comprises a cylindrical heat transfer pipe body 10 and a plurality of spiral fins 11 integrally formed on the outer surface of the body 10. The upper portion of each of the fins 11 has one or more circumferential grooves 13 which divide the upper portion of each fin 11 into three parts 11*a*, 11*b* and 11*c*. In addition, the upper portion of each fin 11 has a plurality of axially extending notches 14 which divide the upper portion of each fin 11 into a number of parts. The depth $h_2$ of each notch 14 is preferably greater than the depth $h_1$ of the circumferential grooves 13 on the upper portion of each fin 11.

Since the fins 11 on the outer surface of the body 10 increase the surface area and the notches 14 dividing the fins 11 into a number of parts further increase the surface area, the efficiency of contact between the refrigerant and the pipe body 10 is very high. Also, the upper portions of the fins 11 are cut into sections by the notches 14 and the grooves 13 are continuous with each other through the associated notches 14, so that the condensate of the refrigerant does not remain in the grooves 13 but instead flows from the grooves 13 between the branched portions 11*a*, 11*b* and 11*c* of the fin 11 into the grooves 12 between the fins 11 through the notches 14 thereby suppressing the formation of liquid film on the upper portions of the fins 11. The above-mentioned dimensional relationship between the notches 14 and the grooves 13 further allows the condensate in the grooves 13 to be removed immediately, thereby more significantly suppressing the formation of the liquid film on the upper branched portions of the fins. Thus, the upper portions of the fins 11 are always exposed to fresh refrigerant, in addition to the considerably large surface area, thereby greatly increasing the efficiency of heat transfer. Liquid film is almost never formed around the edges of the notches 14 so that heat exchange can be efficiently conducted in these areas. Therefore, the rate of heat transfer from the refrigerant to the pipe wall increases significantly.

Figure 1:
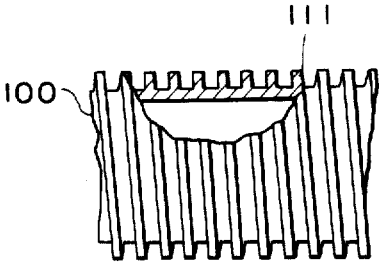
FIG. 1 PRIOR ART
FIG. 1 is a partial sectional side view of a conventional spiral fin type heat transfer pipe.
Figure 2:
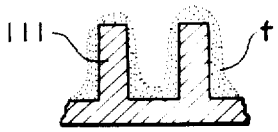
FIG. 2 PRIOR ART
FIGS. 2 and 3, respectively, are partly enlarged sectional side views illustrating the remaining condensate of the refrigerant on the fins of the conventional pipe.
Figure 3:
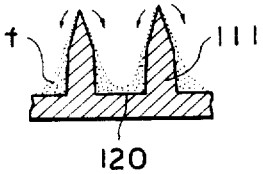
FIG. 3 PRIOR ART
Figure 4:
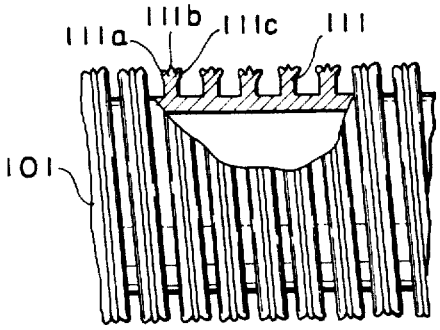
FIGS. 4 and 5, respectively, are a partial sectional side view and a partial enlarged perspective view of a comparative heat transfer pipe to be compared with a heat transfer pipe according to this invention.
Figure 5:
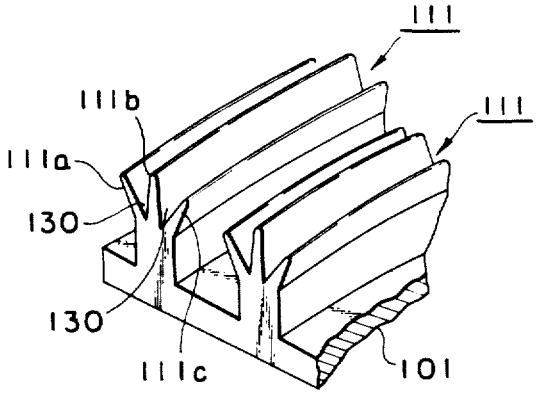

FIGS. 4 and 5 show a heat transfer pipe 101 which is not provided with the axially extending notches as formed in the above-mentiond heat transfer pipe 1 according to this invention, so that the condensate of refrigerant would remain in the grooves 130 between the upper branched portions 111*a*, 111*b* and 111*c* of the fins 111 to form liquid film which substantially decreases the efficiency of heat transfer.

Figure 10:
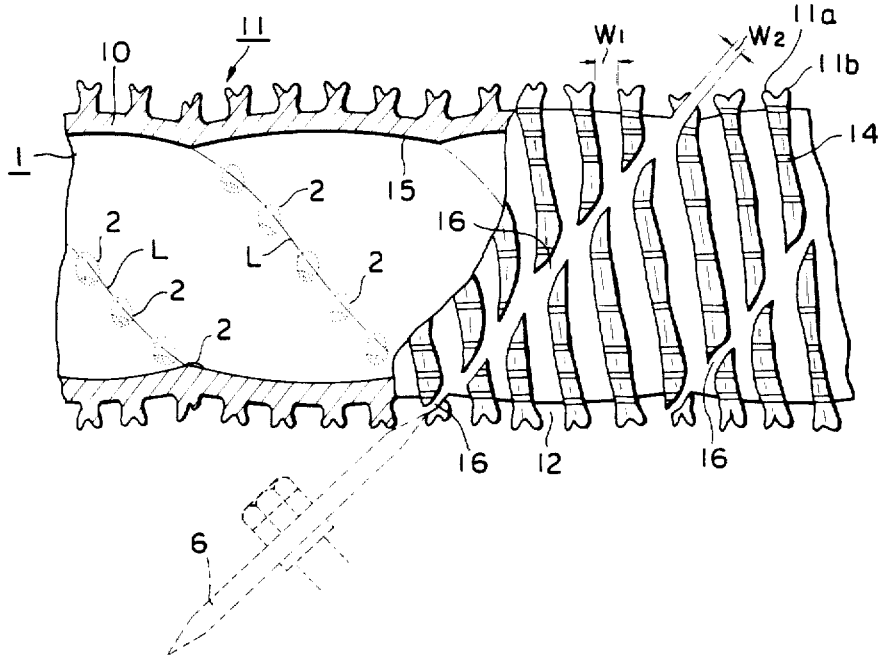
FIGS. 10 and 11, respectively, are a partial sectional view and a partial perspective view showing another heat transfer pipe according to this invention.
Figure 13:
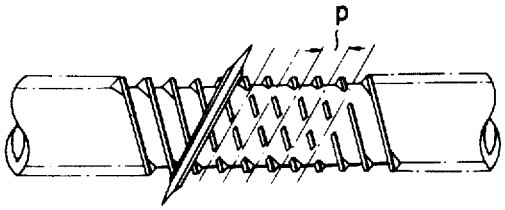
FIG. 13 is an explanatory view showing a heat transfer pipe according to this invention.

FIG. 10 shows another heat transfer pipe 1 according to this invention wherein a plurality of spiral fins 11 further have notches 16 formed therein with a predetermined pitch (reference P in FIG. 13) to divide them into a plurality of sections, and a plurality of discrete beads 2 are integrally formed on the inner surface of the pipe body 10 along imaginary lines L having a lead angle which is in reverse relation to the lead angle of the fins 11. The beads 2 are formed on at least some of the intersections between the imaginary lines L and the fins 11. The beads 2 may be irregularly formed on the inner surface of the pipe body 10. In addition, arcuate inner surface portions 15 are formed in the interior of the pipe body 10. The beads 2 or the same in combination with the inner surface portions 15 cause to disturb the flow of cooling liquid within the heat transfer pipe 1 thereby bringing the cooling liquid, in a turbulent state, into contact with the heat transfer pipe wall so that the rate of heat transfer from the pipe wall to the cooling liquid increase significantly. Thus, the beads 2 and the inner surface portions 15 create a superior heat transfer effect.

Figure 11:
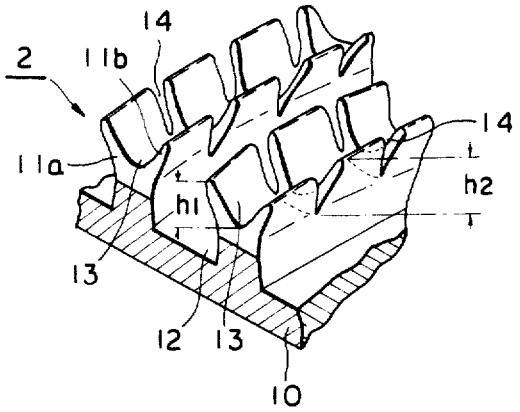

The fins 11 on the outer surface of the pipe body 10, as seen from FIG. 11, have one or more circumferential grooves 13 and a plurality of axially extending notches 14 on its upper portions, as formed in the heat transfer pipe 1 shown in FIG. 6, wherein the dimensional relationship between the depth $h_2$ of the notches 14 and the depth $h_1$ of the grooves 13 is preferably in the relation $h_2 > h_1$, as well. Therefore, the same advantages mentioned as before are attained.

Figure 7:
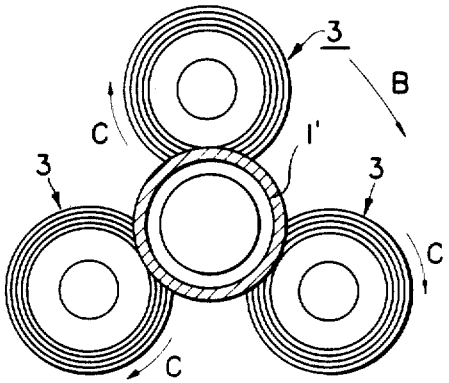
FIGS. 7 and 8, respectively, are illustrative views showing a manufacturing process of the heat transfer pipe shown in FIG. 6.
Figure 8:
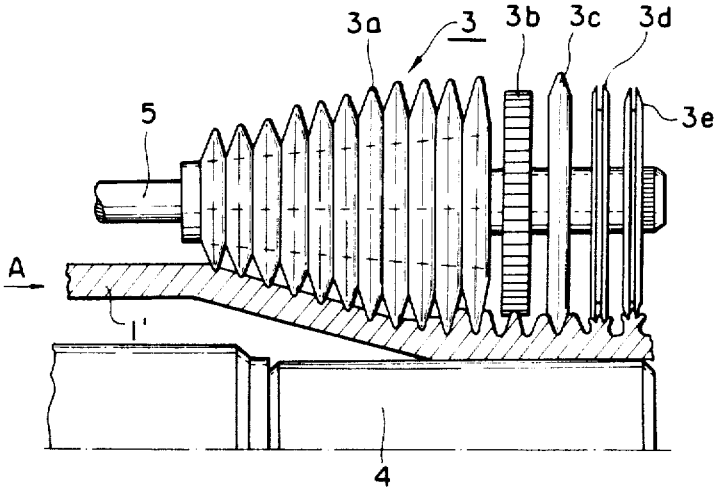
Figure 12:
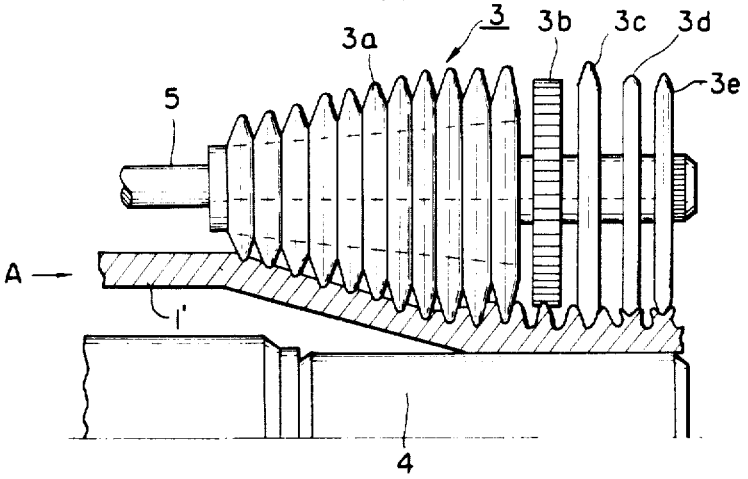
FIG. 12 is an illustration view showing a manufacturing process of the pipe shown in FIG. 10.

The heat transfer pipe 1 according to this invention is manufactured as follows:

FIGS. 7, 8 and 12, respectively, show a manufacturing process of the heat transfer pipe 1. A cylindrical pipe 1' having a smooth surface and made of metallic materials such as Cu, Al, an alloy thereof or the like, which is held by a mandrel 4 is moved ahead in the direction of arrow A while rolling tools 3 in the direction of arrow B (each tool rolls in the direction of arrow C) to form the spiral fins 11. Each rolling tool 3 comprises a plurality of pre-rolling discs 3*a*, a cutting tool 3*b* for cutting axial notches, an exterior surface adjusting disc 3*c*, a cutting tool 3*d* for cutting circumferential grooves and a finishing disc 3*e*, all of which are rotatable around the axis 5 thereof, respectively. The diameter of the successive pre-rolling discs 3*a* is greater in the forward section so as to gradually press grooves in a crushing manner into the surface of the pipe 1', thereby forming the spiral grooves 12. At the same time, the bulges of excess pipe wall material are crushed to form the spiral fins 11 surrounding these grooves 12.

Figure 9:
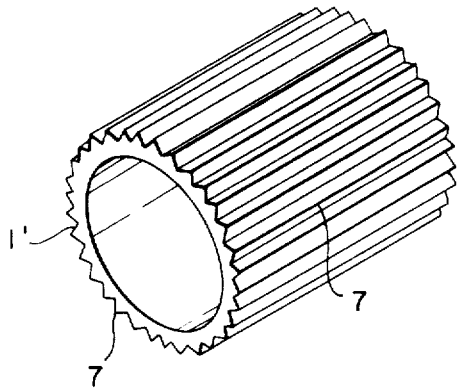
FIG. 9 is a perspective view showing a heat transfer pipe in accordance with the present invention.

Cutting tool 3*b* then works to form a plurality of axially extending notches 14 in the upper portion of the spiral fins 11. The next disc 3*c* works to adjust the shape of the fins 11 and the cutting tool 3*d* cuts into the grooves 13 to form the branched parts 11*a*, 11*b* and 11*c* or 11*a* and 11*b* on the upper portion of the fins 11. Then, the finishing disc 3*e* adjusts the shape of the upper portion of the fins 11, thereby obtaining the desired heat transfer pipe 1 having spiral fins with the branched portions 11*a*, 11*b* and 11*c* as shown in FIG. 6. Another pipe 1' to be used in this invention is shown in FIG. 9, has a number of rows of axially running projections 7 on its outer surface which function as the notches 14 in the final product. Thus, using this pipe 1', the cutting tool 3b shown in FIG. 8 may be omitted.

The heat transfer pipe 1 shown in FIG. 10 is produced by further pressing a sharp edged rotary tool 6 against the outer surface of the resulting heat transfer pipe in FIG. 6 while rolling the tool 6 in a direction which crosses the fins 11 while rotating the pipe, thereby crushing while cutting the fins 11 with a predetermined pitch to form the breaks 16. The excess pipe wall material is crushed at the breaks 16, the bulges forming beads 2 on the inner surface of the pipe 1 while circumferentially squeezing the pipe to form the repeated continuous waves 15 on the inner surface of the pipe. According to this method, it is possible to form the beads 2 and the waves 15 concurrently with the breaks 16, with the beads 2 formed on the inner surface directly opposite to the breaks 16, so that the spacing of the breaks 16 necessarily coincides with the spacing of the beads 2. Therefore, by adjusting the direction of rolling of the rotary tool 6 forming the breaks 16, it is possible for the imaginary lines L connecting the beads 2 to assume a spiral form. When the rotary tool 6 is rolled in the axial direction of the pipe, it is possible to form the breaks 16 and the beads 2 along imaginary lines which are parallel to the axis of the pipe. In some cases, the rotary tool 6 may be rolled in the circumferential direction of the pipe to form the breaks and beads along circumferential imaginary lines.

The waves 15 on the inner surface of the heat transfer pipe are formed not only by the beads 2 and the bulges in the peripheral regions but also by the circumferential pressure from the rotary tool 6 circumferentially squeezing the material. These actions result in undulations having a definite wave length in the direction of the pipe axis, thus forming waves 15. The size of the waves 15 can be adjusted as desired by adjusting the pressure on the rotary tool. Thus, by controlling said pressure with consideration given to pressure loss on the inner surface, the turbulent effect may be increased.

In addition, in the heat transfer pipe of this invention, the space $W_1$ between the fins 11 and the width $W_2$ of the notches 16 are preferably in the relation $W_1 > W_2$. In the present invention, since the notches 16 are formed by crushing the fins 11 rather than by cutting or shearing the same, $W_1 > W_2$ would decrease the effective area of the outer surface, failing to attain the objects of this invention.

As described above, the height of the fins of the heat transfer pipe according to this invention is roughly equal to that of the conventional low fin heat transfer pipe, thereby obtaining compact condensers including a number of said heat transfer pipes therein. The fins have a large number of notches 14 and 16 at predetermined intervals thereby increasing the surface area of the fins themselves, namely, the effective area of heat transfer. Moreover, the formation of the notches in the fins prevents the formation and the residence of condensate films. These effects combine to greatly increase the efficiency of heat transfer on the refrigerant side.

The formation of a large number of the beads with the waves on the surface of the cooling liquid side disturb the cooling liquid, so that it is possible to achieve a sufficient rate of heat transfer on the cooling liquid side without having to substantially increase the rate of flow.

EXAMPLE 1

Figure 14:
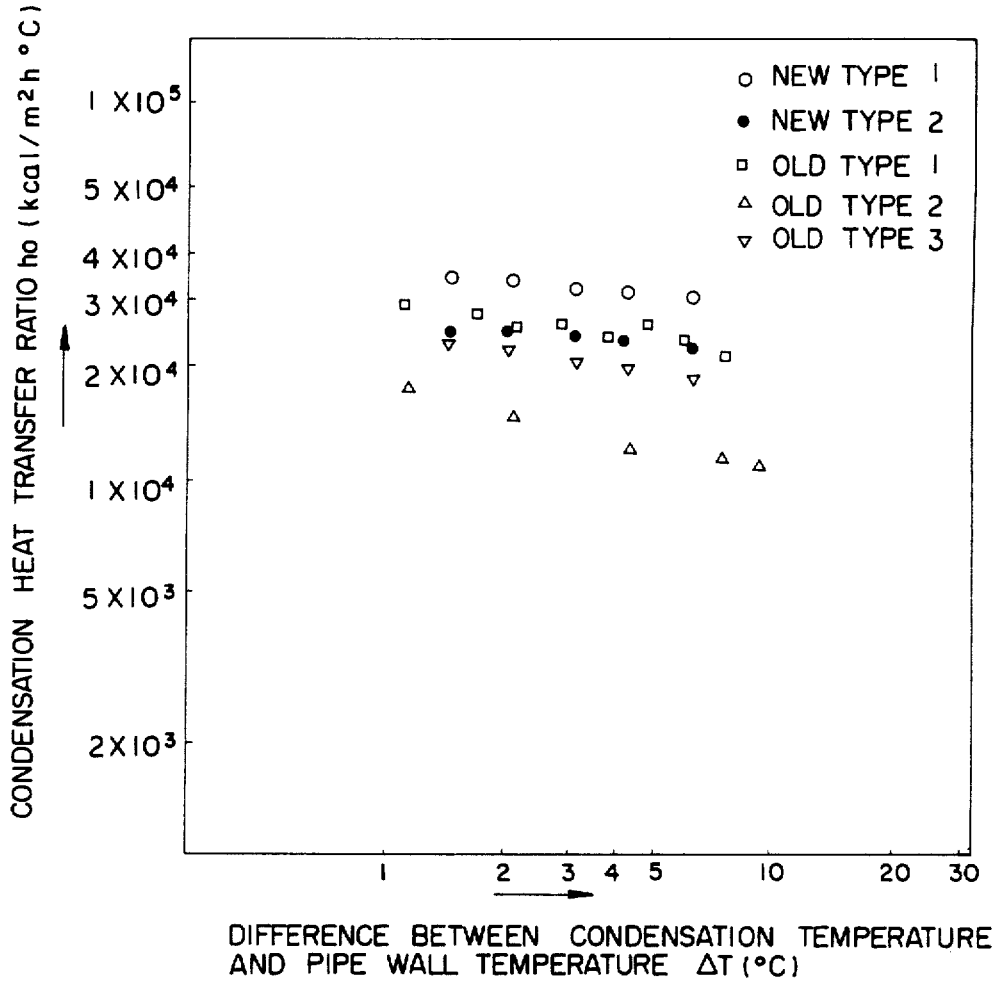
FIGS. 14 and 15 are graphs showing the effects of this invention.

The heat transfer pipes according to this invention, the configuration and the dimensions of which are described in Table 1, were examined and compared with the conventional pipes with regard to the condensation heat transfer ratio (Kcal/m$^2$.hr.°C.) by passing water as a cooling liquid through the pipe and R22 gas as a refrigerant over the outer surface of the pipe, said refrigerant being allowed to condense. The results are shown in FIG. 14, which indicates that the heat transfer ratio of pipe using the newly invented configuration (New Sample Type 1) is 2.3 to 2.6 times higher than that of pipe using a conventional low fin heat transfer configuration (Old Sample Type 2). Therefore, it is possible to obtain a high ratio of heat transfer using a compact and light-weight heat transfer pipe produced according to this invention.

TABLE 1

| | New | | Old | | |
|---|---|---|---|---|---|
| | Sample Type 1 | Sample Type 2 | Sample Type 1 | Sample Type 2 | Sample Type 3 |
| Outer diameters of original pipe (mm) | 19.05 | 19.05 | 19.05 | 19.05 | 19.05 |
| Wall thickness of original pipe (mm) | 1.4 | 1.4 | 1.4 | 1.4 | 1.4 |
| Number of fins/ longitudinal length 25.4 mm | 28 | 28 | 35 | 28 | 28 |
| Height of fins (mm) | 1.25 | 1.25 | 0.9 | 1.4 | 1.25 |
| Number of branched portions of upper part of each fin | 2 | 2 | — | — | 2 |
| Depth of grooves between branched portions of fins (mm) | 0.5 | 0.5 | — | — | 0.5 |
| Number of circumferential notches | 75 | 75 | 75 | — | — |
| Pitch of the above notches (mm) | 0.8 | 0.8 | 0.8 | — | — |
| Depth of the above notches (mm) | 0.7 | 0.3 | 0.7 | — | — |

EXAMPLE 2

Figure 15:
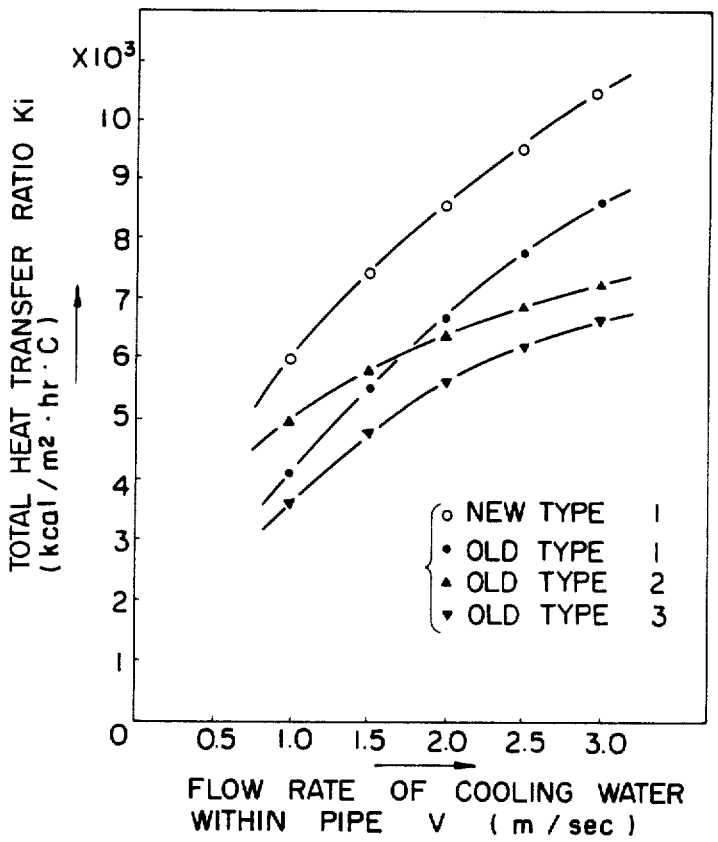

The heat transfer pipe according to this invention, the configuration and dimensions of which are described in Table 2, was examined and compared with the conventional pipes with regard to the total heat transfer ratio (Kcal/m$^2$.hr.°C.) at a flow rate of cooling water within the pipe, given the fact that the amount of heat transfer per unit length (1 m) of the pipe is 2500 Kcal/hr. The results are shown in FIG. 15, which indicate that the total heat transfer ratio of the present invention's pipe is about 1.6 times higher than that of the conventional low fin heat transfer pipe (Old Sample Type 3) and about 1.4 times higher than that of another pipe (Old Sample Type 1). Thus, it is possible to produce a compact and light-weight condenser using the heat transfer pipe (New Sample Type 1 in Example 2) according to this invention, which has a total heat transfer ratio better than the conventional heat transfer pipes.

TABLE 2

| | New | Old | | |
|---|---|---|---|---|
| | Sample Type 1 | Sample Type 1 | Sample Type 2 | Sample Type 3 |
| Outer diameter of | 19.05 | 19.05 | 19.05 | 19.05 |

TABLE 2-continued

| | New | Old | | |
|---|---|---|---|---|
| | Sample Type 1 | Sample Type 1 | Sample Type 2 | Sample Type 3 |
| original pipe (mm) | | | | |
| Wall thickness of original pipe (mm) | 1.4 | 1.4 | 1.4 | 1.4 |
| Number of fins/ longitudinal length 25.4 mm | 28 | 28 | 28 | 28 |
| Height of fins (mm) | 1.25 | 1.25 | 1.4 | 1.4 |
| Number of branched portions of upper part of each fin | 2 | 2 | — | — |
| Depth of grooves between branched portions of fins (mm) | 0.5 | 0.5 | — | — |
| Number of circumferential notches | 75 | 75 | — | — |
| Pitch of the above notches (mm) | 0.8 | 0.8 | — | — |
| Depth of the above notches (mm) | 0.7 | 0.7 | — | — |
| Pitch P of spiral notches (mm) (see FIG. 13) | 4 | — | 4 | — |

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty which reside in the present invention, including all features which would be treated as equivalents thereof by those skilled in the art to which this invention pertains.

What is claimed is:

1. A heat transfer pipe comprising:

(a) an axially hollow cylindrical heat transfer pipe body and (b) a plurality of circumferential fins integrally formed on the outer surface of said cylindrical heat transfer pipe body at a first regular circumferential pitch which leaves a circumferential space between said circumferential fins, each of said circumferential fins having a circumferential axis extending circumferentially around said cylindrical heat transfer pipe body;

(c) the radially outer portion of each of said circumferential fins having at least one groove extending along the axial length of said circumferential fin to divide the radially outer portion of said circumferential fin into at least two parts separated by said at least one groove, (d) each of said circumferential fins also having a plurality of notches therein interrupting the axial length of said circumferential fins and dividing said circumferential fins into a number of parts, (e) a plurality of discrete beads being formed on the inner surface of said axially hollow cylindrical heat transfer pipe body along imaginary circumferential lines, said beads being formed at points directly radially underlying at least some of said circumferential fins, (f) the depth of said notches in the radial direction being greater than the depth of said at least one groove, whereby condensate on the exterior of said heat transfer pipe does not remain in said grooves but instead flows from said grooves into said notches and from there into the circumferential spaces between said circumferential fins, (g) the circumferential spaces between said circumferential fins being wider than the width of said notches, thereby increasing the effective thermal transfer area of the heat transfer pipe, and (h) the axial width of said circumferential spaces between said circumferential fins being wider than the width of said grooves, whereby said circumferential spaces are relatively open in the radially outward direction.

2. A heat transfer pipe as recited in claim 1 wherein a plurality of said grooves are formed in the radially outer portion of each of said circumferential fins, said plurality of grooves being separated by a second regular circumferential pitch.

3. A heat transfer pipe as recited in claim 1 wherein said notches extend in the axial direction of said cylindrical heat transfer pipe body.

4. A heat transfer pipe as recited in claim 1 wherein said notches are disposed in spiral array on the outer surface of said cylindrical heat transfer pipe body.

5. A heat transfer pipe as recited in claim 1 adapted to cool an external medium passed along its outer surface when a cooling medium is passed along its inner surface.

6. A heat transfer pipe comprising:

(a) an axially hollow cylindrical heat transfer pipe body and (b) a plurality of spiral fins integrally formed on the outer surface of said cylindrical heat transfer pipe body at a first regular spiral pitch which leaves a spiral space between said spiral fins, each of said spiral fins having a spiral axis extending spirally around said cylindrical heat transfer pipe body;

(c) the radially outer portion of each of said spiral fins having at least one groove extending along the axial length of said spiral fin to divide the radially outer portion of said spiral fin into at least two parts separated by said at least one groove, (d) each of said spiral fins also having a plurality of notches therein interrupting the axial length of said spiral fins and dividing said spiral fins into a number of parts, (e) a plurality of discrete beads being formed on the inner surface of said axially hollow cylindrical heat transfer pipe body along imaginary spiral lines, said beads being formed at points directly radially underlying at least some of said spiral fins, (f) the depth of said notches in the radial direction being greater than the depth of said at least one groove, whereby condensate on the exterior of said heat transfer pipe does not remain in said grooves but instead flows from said grooves into said notches and from there into the spiral spaces between said spiral fins, (g) the spiral spaces between said spiral fins being wider than the width of said notches, thereby increasing the effective thermal transfer area of the heat transfer pipe, and (h) the axial width of said spiral spaces between said spiral fins being wider than the width of said grooves, whereby said spiral spaces are relatively open in the radially outward direction.

7. A heat transfer pipe as recited in claim 6 wherein radial lines extending through said imaginary lines intersect the spiral axes of said fins.

8. A heat transfer pipe as recited in claim 6 wherein a plurality of said grooves are formed in the radially outer portion of each of said spiral fins, said plurality of grooves being separated by a second regular spiral pitch.

9. A heat transfer pipe as recited in claim 6 wherein said notch is extended in the axial direction in said cylindrical heat transfer pipe body.

10. A heat transfer pipe as recited in claim 6 wherein said notches are disposed in spiral array on the outer surface of said cylindrical heat transfer pipe body.

11. A heat transfer pipe as recited in claim 6 adapted to cool an external medium passed along its outer surface when a cooling medium is passed along its inner surface.

* * * * *